US007699141B2

(12) United States Patent
Fossier et al.

(10) Patent No.: US 7,699,141 B2
(45) Date of Patent: Apr. 20, 2010

(54) PALLET DISTANCE RANGING DEVICE FOR FORKLIFT

(76) Inventors: David A. Fossier, 325 Fieldcrest La., Cincinnati, OH (US) 45140; William Chemick, 4965 Lord Alferd Ct., Cincinnati, OH (US) 45241

( * ) Notice: Subject to any disclaimer, the term of this patent is extended or adjusted under 35 U.S.C. 154(b) by 324 days.

(21) Appl. No.: 11/725,107

(22) Filed: Mar. 16, 2007

(65) Prior Publication Data

US 2007/0215412 A1 Sep. 20, 2007

Related U.S. Application Data

(60) Provisional application No. 60/783,967, filed on Mar. 20, 2006.

(51) Int. Cl.
*B66F 9/06* (2006.01)

(52) U.S. Cl. ..... 187/222; 187/227; 414/641; 414/663

(58) Field of Classification Search ..... 187/222, 187/224, 227, 237; 414/641, 660, 661, 663
See application file for complete search history.

(56) References Cited

U.S. PATENT DOCUMENTS 4,279,328 A * 7/1981 Ahlbom ..... 187/224
5,052,882 A * 10/1991 Blau et al. ..... 414/667
5,113,349 A * 5/1992 Nakamura et al. ..... 700/215
5,738,187 A * 4/1998 Dammeyer et al. ..... 187/222
6,838,655 B2 * 1/2005 Heimlicher ..... 250/221
7,010,404 B2 * 3/2006 Ichijo et al. ..... 701/50
7,219,769 B2 * 5/2007 Yamanouchi et al. ..... 187/227
7,320,385 B2 * 1/2008 Katae et al. ..... 187/227
2004/0083025 A1 * 4/2004 Yamanouchi et al. ..... 700/213
2006/0280585 A1 * 12/2006 Passeri et al. ..... 414/667
2008/0202856 A1 * 8/2008 Fossier et al. ..... 187/224

FOREIGN PATENT DOCUMENTS

JP 03003899 A * 1/1991
JP 04217595 A * 8/1992
JP 05024799 A * 2/1993

* cited by examiner

*Primary Examiner*—Walter Benson
*Assistant Examiner*—Eduardo Colon-Santana

(57) ABSTRACT

The invention is a device mounted on a forklift to provide the operator with information of the distance from the pallet load to the upright part of the fork/tines. The invention has a source of a range determining signal such as sonic waves but other signals such as infra red or radar waves may be used. The emitted signals hit the palletized goods and are reflected to a detector or sensor and processed. The range information is transferred to a distance display device. The range/distance between the upright part of forklift tines and the palletized load combined with knowledge of the length of floor parallel tines of the forks will provide information to prevent any excessive penetration of the pallet hollow which excessive penetration can cause damage to either truck trailer walls, warehouse structures, or other palletized loads.

3 Claims, 5 Drawing Sheets

FIGURE 1 Replacement Sheet

PALLET DISTANCE RANGING DEVICE FOR FORKLIFT

The present application claims the benefit of U.S. provisional patent application No. 60/783,967, filed Mar. 20, 2006.

FIELD OF INVENTION

The invention is concerned with safe and non-damaging operation of forklifts which move pallets of goods. Forklifts are also known as Industrial Powered Vehicles. The invention provides distance or range information to the forklift operator so that the goods on the pallet are not damaged. More specifically, the invention is concerned with providing variable distance data to the operator of the forklift which information informs the operator of the distance between the fork perpendicular back and the pallet.

BACKGROUND OF INVENTION

The rapid and efficient movement of most commercial goods is wholly dependent upon powered industrial vehicles known as forklifts. Forklifts for the most part have short cast steel bodies with a short turn radius and an electric or internal combustion engine. The forklift has a pair of forks/tines that can be adjusted so that the base and floor perpendicular tines can be raised and lowered as desired. Likewise the operator may adjust to different widths between the forks.

Forklifts are used for goods that are to be moved from point A to point B such as from the hollow of a truck trailer to a storage area in the warehouse. Ordinarily, such goods are on a pallet which is a raised platform with a hollow underneath to receive the forks. In operation, the forklift driver will approach the pallet and after squaring up will move the floor parallel forks into the pallet hollow. The forks, with the load, are then raised and forklift is driven to the receiving place for the pallet of goods. After the loaded pallet is lowered, the forklift backs up and the driver seeks new load.

While the process is essentially simple, there are numerous problems with the generic system. For example, the pallet may be 42 inches long/deep and the forklift parallel forks may be 60 inches long. If the pallets are back to back an unwary operator may drive through the first pallet hollow into the second pallet hollow and begin to raise his forks. The second pallet will then tip over. Such an accident may injure an unwary worker or damage the goods such as spilling raw materials. This can cause a difficult to clean up mess along with other economic costs.

Additionally, if the unwary driver is unloading a truck the potential exists for the operator to punch holes through the thin walls of a truck trailer or damage the walls of a building. With Range ALERT™ the driver has a digital readout on his dashboard that tells him the distance he is into his load.

An early version of Range ALERT™, *Pallet Distance Ranging Device* for Forklift was developed by Process Automation in the fall of 2001 for General Motors. This design had 3 preset ranges and hence was limited to three container sizes. The present inventors were approached in October of 2004 by the R. E. Michel Company to design a version of Range ALERT™ that would work when moving many different sized containers and products. The inventors worked with R. E. Michel to develop the current Range ALERT™. The invention has a digital display that can be used with many different sized containers and loads. The first prototype system of this product was delivered for evaluation to R. E. Michel on Jan. 29, 2005. The present inventors developed a product brochure and began showing the Range ALERT™ with the Digital Display to the public at the Ohio BWC Safety Congress in Columbus on Mar. 23, 2005.

SUMMARY OF INVENTION

The invention is a range finding device mounted on a forklift. This device has an emitter of range determining signal, which signal reflects from workpiece pallet load of product. The reflected signal is accepted by a detector, transferred to a processor to analyze the sent and reflected signal. This combination of emitter, reflected signal, and processor determines the range between said forklift tines and workpiece pallet load.

The range determining information is transmitted from processor to a distance display device. The distance display device informs the forklift operator of the actual distance/range between the floor perpendicular fork and said pallet load. Information from the sensor is transmitted a processor and/or distance display device by wire or wireless transfer means.

The information from the sensor detector is incorporated with the pallet barcode information in the forklift computer and sent to that display device which will then inform the operator that pallet load is "Safe to Lift" or equivalent.

The distance display device, emitter, receiver, and detector are mounted on a forklift.

DETAILED DESCRIPTION OF INVENTION

Figure 1:
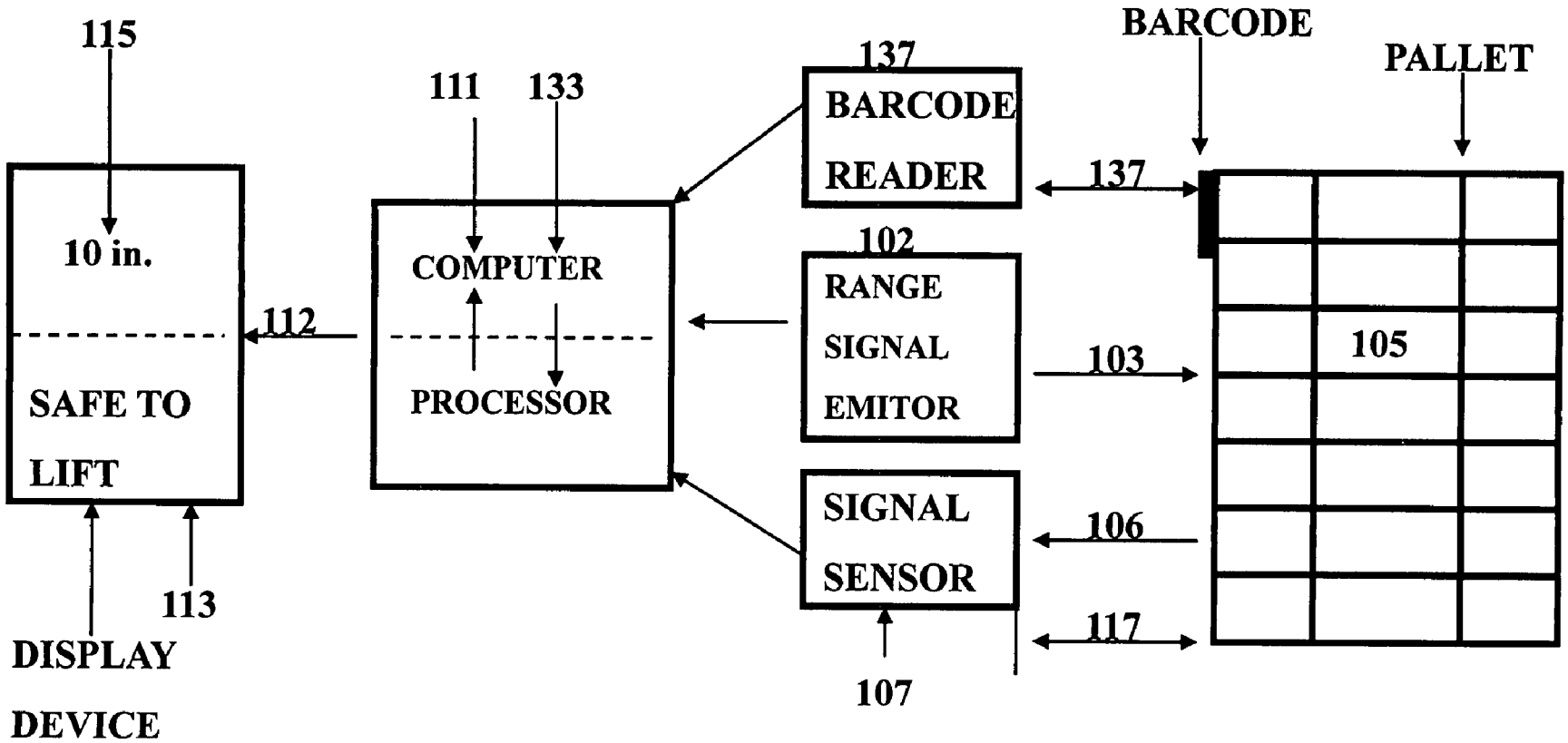
FIG. 1 shows the generic elements of the invention 101 which is mounted on a forklift.

FIG. 1 shows the generic elements of the invention 101 which as an invention is mounted on a forklift (tow motor) also known as an Industrial Powered Vehicle. Box 102 is a source of a range determining signal. In the preferred embodiment the signal consists of sonic waves but other signals such as infra red or radar waves may be used. The emitted signals shown as 103 hit the workpiece object (in this case the palletized goods) 105. The range to be measured is 117. Workpiece pallet load 105 reflects the signals 106 which are received by the detector (sensor) 107. The recorded electronic signals are transmitted either by wire or wireless to processor (sensor) 111. From processor 111 the digital information 112 is transferred either by wire or wireless to the distance display device 113. In the present instance the distance/range 117 between the box 102 the source of the determining signal and the workpiece object 105 is 10 inches, 115. Note that FIG. 1 shows the elements of the present invention as if they are physically distant. In the preferred embodiment, the elements may be in a single bundled package or separate. For example the display 115 may be located physically removed from the processor or base unit. Current art teaches many operating forklifts are now equipped with bar code readers 137. Arrow 137 schematically shows the bar code information being acquired by workpiece computer 133. Computer 133 sends information incorporated in the barcode of the palletized goods to the operator so that the pallets may be loaded properly onto trucks.

For this reason optionally the information from bar code readers 137 and computer 133 is transferred either by wire or wireless 135 to forklift processor 111. The information from sensor 107 is thereby incorporated with other information 137 in forklift computer 133 and sent 112 to display 115. Display 115 will then inform the operator that pallet load is "Safe to Lift" or equivalents.

Figure 2:
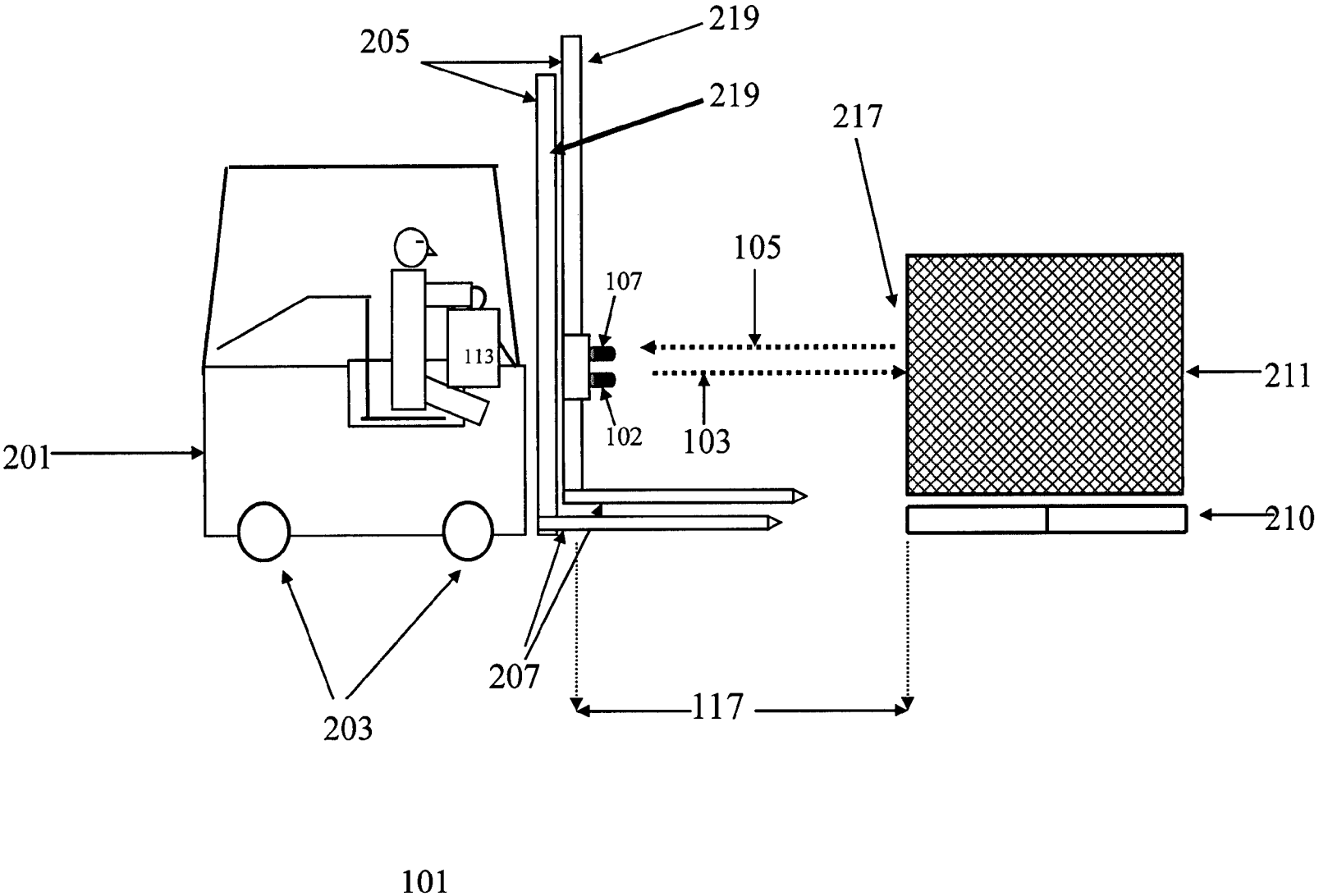
FIG. 2 shows the inventive device mounted on the workpiece forklift.

FIG. 2 shows the inventive element, that is the device 101 of FIG. 1, mounted on the workpiece forklift 201 to create the invention. Workpiece forklift 201 has wheels 203, floor perpendicular forks 205, and floor parallel forks 207. The emitter of range determining signal is mounted on same plane with pallet side 210 of floor perpendicular forks 205 to create point zero. Point zero, or starting point, is the pallet side 219 of floor perpendicular forks 205. However, forklifts and their respective forks may have different physical structures. For this reason, the present invention has an electronic control to adjust the equitant range if the emitter and sensor of the sonic waves is not mounted in the actual plane between the floor perpendicular forks. For example, the processor would automatically add three inches if the emitter and sensor are placed three inches behind the plane of the floor perpendicular forks. This adjustment is part of the processing program and is adjusted for each individual installation. The equitant range 103 between pallet side 219 and workpiece pallet 210 with goods 211 is measured by emitted signal 105. The distance 117 as measured by the signal box emitter 102 and detector 107 is placed on distance display 113 to inform the forklift operator of the distance to the face 217 of the palletized goods 211.

Figure 3:
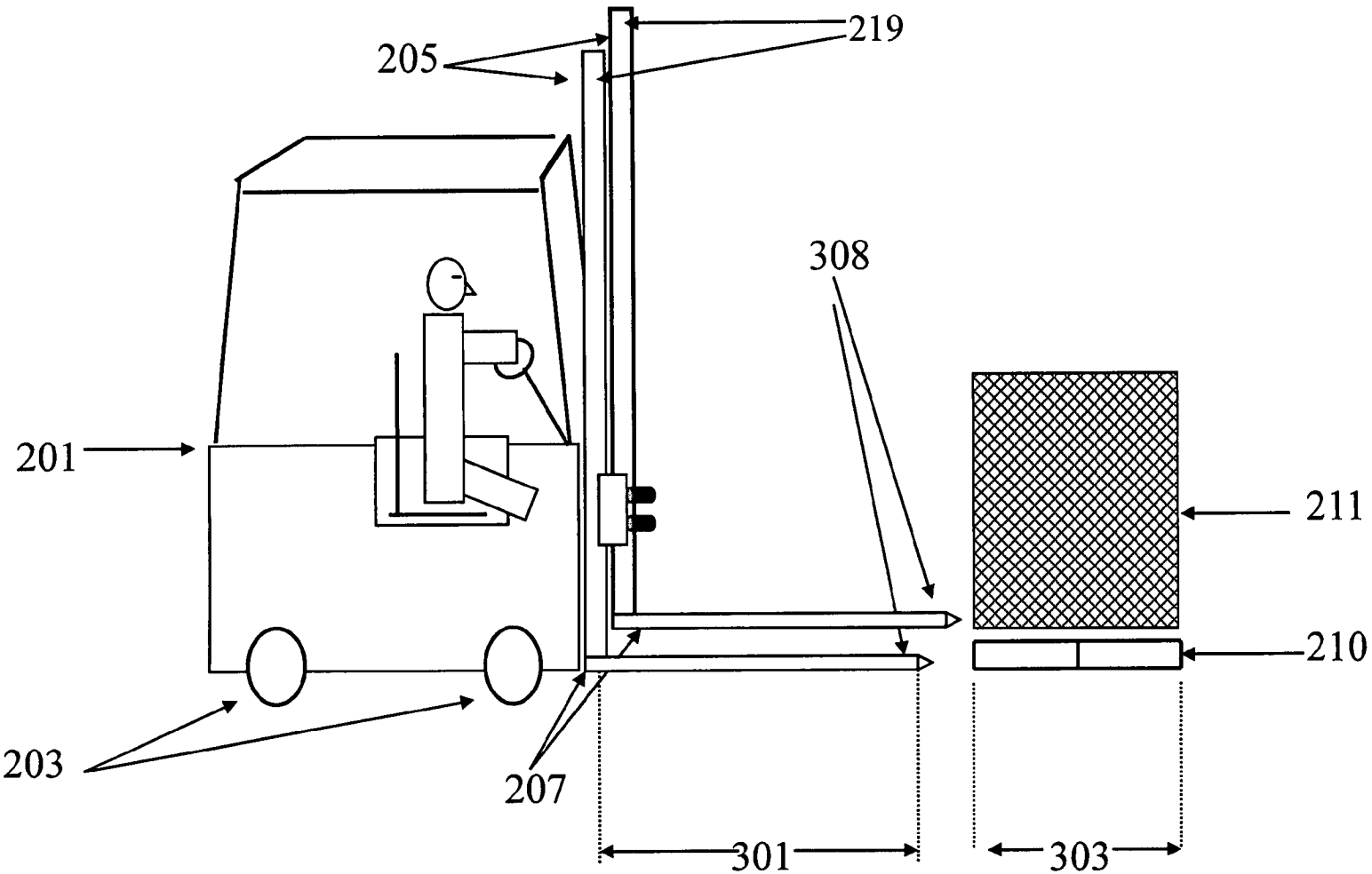
FIG. 3 shows a common cause of forklift physical damage to the goods, truck trailer or warehouse.

FIG. 3 shows a common cause of forklift physical damage to the goods, truck trailer or warehouse. Workpiece forklift 201 has wheels 203, floor perpendicular forks 205 and floor parallel forks 207. Sensor 101 is mounted at starting point zero which is normally on the same plane as the pallet side 219 of floor perpendicular forks 205. The length of base 301 of fork 207 from pallet side 219 to tip of forks 308 is significantly greater than the width of the pallet 210 with goods 211.

Figure 4:
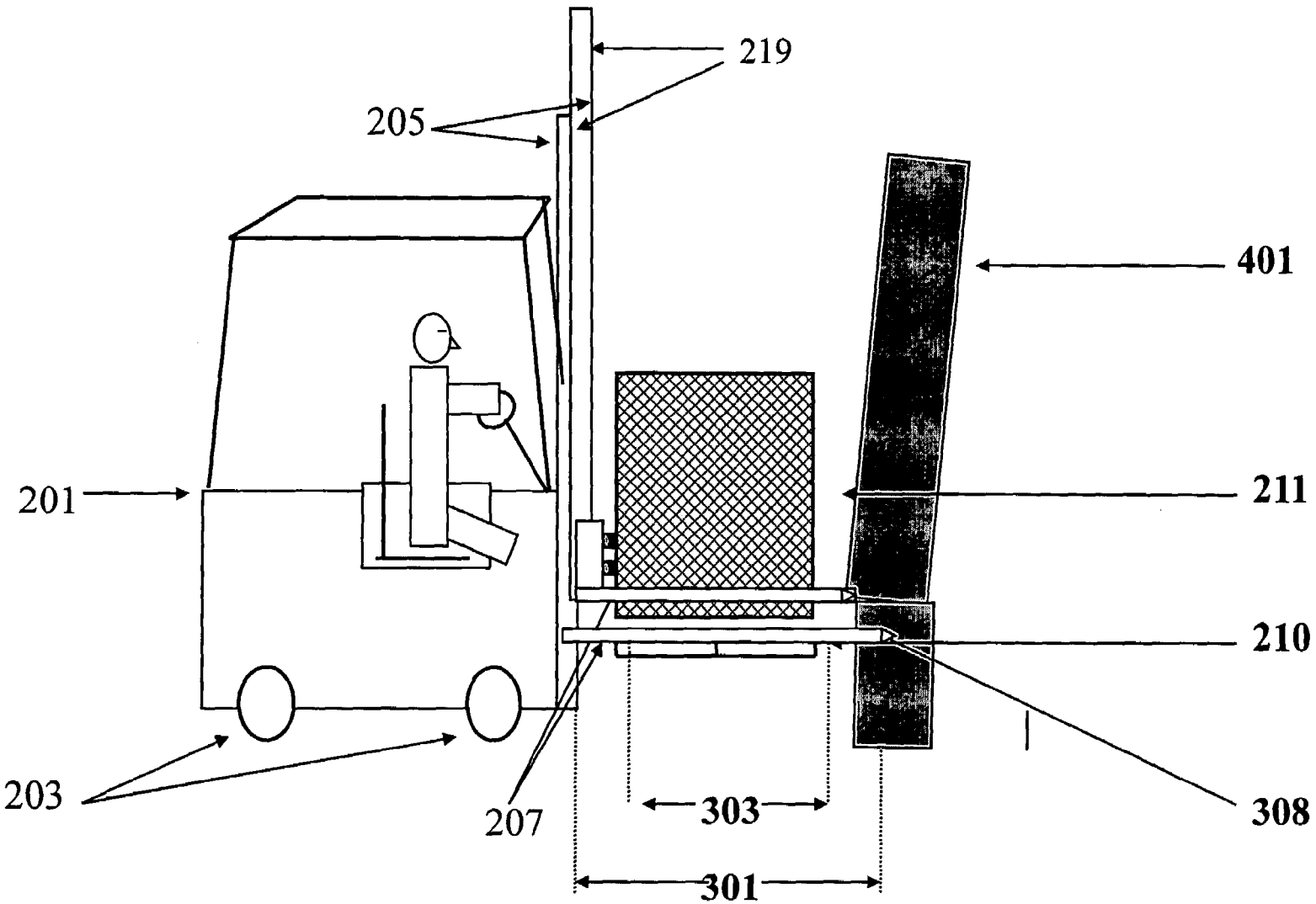
FIG. 4 shows kinds of physical damage to truck trailer or warehouse.

FIG. 4 shows kinds of physical damage to truck trailer or warehouse. Workpiece forklift 201 has wheels 203, floor perpendicular forks 205 and floor parallel forks 207. The length of base 301 of fork 207 from pallet side 219 to tip of fork 308 is significantly greater than the width of the pallet 210 with goods 211. If the driver is not informed or careless the tip 308 of longer floor parallel fork 301 can penetrate and damage the workpiece wall 401. The present invention can inform the operator of the distance and can prevent this kind of damage as well as other kinds of damage cause by misjudgment of the distance between the floor perpendicular forks and the pallet.

Figure 5:
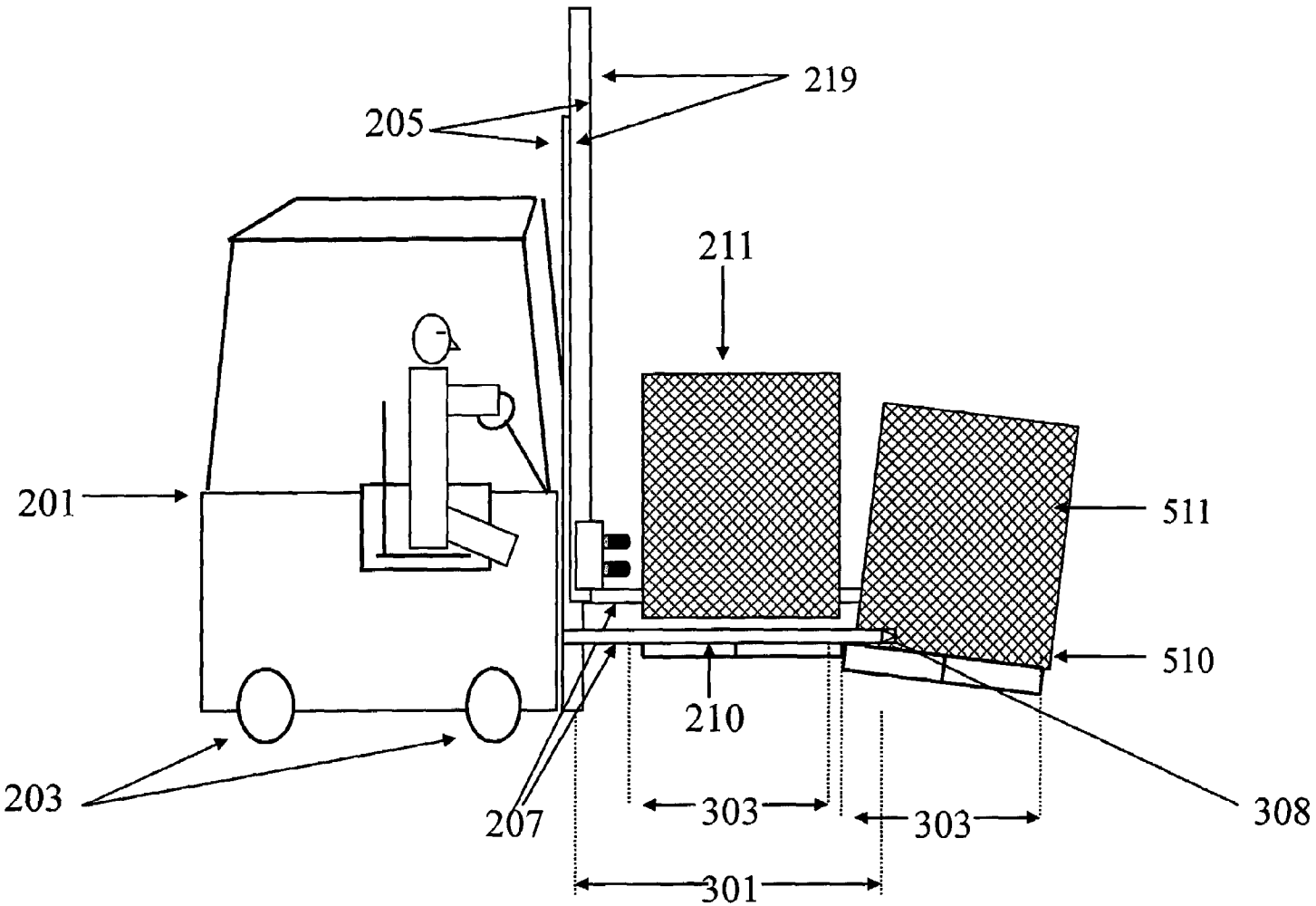
FIG. 5 illustrates other types of physical damage caused by an uninformed or careless operator of forklift.

FIG. 5 illustrates other types of physical damage caused by an uninformed or careless operator of forklift 201. Workpiece forklift 201 has wheels 203, floor perpendicular forks 205 and floor parallel forks 207. The length 301 of floor parallel fork 207 from pallet side 219 to tip 308 of floor parallel fork 207 is significantly greater than the width 303 of first pallet 210 with goods 211. If the driver is not informed or careless the tip 308 of longer floor parallel fork 301 can penetrate a second pallet 510 with pallet load 511. As illustrated in FIG. 5 the partial penetration into second pallet 510 hollow can cause second pallet load 511 to tilt as second pallet 510 penetrated by forks 207 is lifted. The present invention can inform the operator of the distance and can prevent damage caused by the tipping of second pallet 510 with pallet load 511 as well as other kinds of damage caused by misjudgment of the distance between the floor perpendicular forks and the pallet.

We claim:

1. A range finding device mounted on a forklift comprising:

an emitter of range determining signal;

said range determining signal reflects from workpiece pallet load of product;

a detector to accept said reflected signal;

a processor to analyze sent and reflected signal to determine the range between said emitter and said workpiece pallet load;

said range determining information is transmitted from said processor to a distance display device;

said distance display device, said emitter, said receiver, and said detector are mounted on said forklift; said forklift has attached tines of a known length;

said distance display device informs the forklift operator of the actual distance/range between the floor perpendicular fork and said pallet load so that the operator will know if penetration depth in a base hollow of the pallet load is less than said known tine length and therefore said load can be safely moved.

2. A range finding device mounted on a forklift as in claim 1, whereas information from said detector is transmitted to said processor and said distance display means by wire or wireless transfer means.

3. A range finding device mounted on a forklift as in claim 1, whereas information from said detector is transmitted by wire or wireless to a forklift computer;

said information from said detector is combined with workpiece bar code information from barcode on pallet and sent to said display device;

said display device will then inform the operator that pallet load is "Safe to Lift" or equivalent information.

* * * * *